US006749444B2

(12) United States Patent
Murr et al.

(10) Patent No.: US 6,749,444 B2
(45) Date of Patent: Jun. 15, 2004

(54) CONNECTOR WITH INTERCHANGEABLE IMPEDANCE TUNER

(75) Inventors: Keith McQuilkin Murr, Etters, PA (US); Robert Alan Kirker, Harrisburg, PA (US); Michael Warren Fogg, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/050,443

(22) Filed: Jan. 16, 2002

(65) Prior Publication Data

US 2003/0134529 A1 Jul. 17, 2003

(51) Int. Cl.[7] ..... H01R 12/00
(52) U.S. Cl. ..... 439/79; 439/620
(58) Field of Search ..... 439/79, 620, 607, 439/108, 101, 941, 676; 174/255

(56) References Cited

U.S. PATENT DOCUMENTS 5,975,960 A 11/1999 Fogg et al. ..... 439/676
6,176,742 B1 * 1/2001 Arnett et al. ..... 439/620
6,379,184 B1 * 4/2002 Bassler et al. ..... 439/607
6,384,341 B1 * 5/2002 Rothermel et al. ..... 174/255
6,402,561 B1 * 6/2002 Chen ..... 439/676
6,527,587 B1 * 3/2003 Ortega et al. ..... 439/608

* cited by examiner

*Primary Examiner*—Alexander Gilman

(57) ABSTRACT

An interchangeable impedance tuner for use in an electrical connector has been provided. The tuner is formed of a dielectric material different than air. The interchangeable impedance tuner may include a plurality of dielectric isolation ribs, wherein a dielectric rib is positioned between two adjacent signal and/or ground contacts. The tuner may also include at least one impedance adjusting metal insert and at least one insert receptacle for slidably receiving the impedance adjusting metal insert. Each impedance adjusting metal insert is oriented parallel to a portion of the contacts. Further, each impedance adjusting metal insert overlaps a portion of one of the differential pairs. A shell covering the housing and the tuner. The shell opens to allow removal of the tuner is also provided. Upon removal of one tuner, a different tuner, having different impedance controlling characteristics may be positioned within the cavity of the electrical connector.

19 Claims, 6 Drawing Sheets

CONNECTOR WITH INTERCHANGEABLE IMPEDANCE TUNER

BACKGROUND OF THE INVENTION

Certain embodiments of the present invention generally relate to a connector for electronic equipment, and more particularly to a connector including an interchangeable tuner for controlling the impedance within the connector.

Connectors are known for interconnecting various electrical media, components, and structures such as printed circuit boards (PCB), coaxial cables, discrete circuit components, flex circuits and the like. The connectors may interconnect signal and/or power lines between two similar or different media, components and structures, such as between a flex circuit and a PCB, between two PCBs and the like. An example of an interconnection between two PCBs is a board-to-board connector. Connectors are offered in a variety of shapes and sizes, depending upon several competing criteria. Within connectors, the shape, size and spacing between contacts also greatly varies. As the shape, size and spacing of the contact changes, so does the impedance exhibited by the contacts.

Today, connectors are being proposed with more and more signal lines within smaller and smaller connector envelopes. Such size reductions and capacity increases have resulted in very close spacing between adjacent contacts within a connector. As contacts became more closely spaced, when carrying high speed signals, adjacent contacts begin to electrically couple with one another. Electrical coupling occurs when one contact becomes influenced by the electromagnetic field produced by an adjacent contact. Electrical coupling causes, among other things, the contacts to exhibit different impedance characteristics than they might otherwise exhibit absent any coupling. Until recently, impedance exhibited by a connector did not degrade performance by an appreciable amount, in part because signal/data transmission rates were relatively low (e.g., less than 500 MHz or 1 Gbits per second). However, newer electronic and electrical systems have been proposed that are able to transmit data signals at speeds approaching and exceeding 1 GHz or 2 Gbits per second. Because the speed of data transmission systems continues to increase, while the physical size of components continues to decrease, even small increases in impedance may pose significant problems, such as signal loss, within a connector and the system.

Many board-to-board systems have been proposed that include connectors that apply differential pairs of signals. Differential signal pairs include complimentary signals such that if one signal in a differential pair switches from 0 V to 1 V, the other signal in the differential pair switches from 1 V to 0 V. Differential pair connectors have been proposed that control impedance by using a predetermined contact-to-contact spacing (e.g., a distance between signal contacts of a differential pair). Impedance is affected by contact-to-contact spacing because impedance increases as capacitance decreases. Capacitance increases as the distance decreases between a signal contact, or tail, and ground or other signal contacts, or contacts. Hence, impedance decreases with decreased contact-to-contact spacing. Conversely, impedance increases with increased contact-to-contact spacing. Therefore, signal contacts of conventional systems are positioned a predetermined distance from adjacent signal contacts in order to yield a desired impedance.

As the distance increases between two contacts in a differential pair or otherwise, the contacts are considered to be "loosely coupled" to one another. Similarly, as the distance is decreased between contacts in a differential pair or otherwise, the contacts are considered to be more "tightly coupled" to one another. Loosening the coupling of signal contacts of a differential pair increases the impedance exhibited at the contacts, while tightening the coupling between signal contacts in a differential pair decreases the impedance.

Increasing the distance between signal contacts of a differential pair also increases the interference, noise and jitter experienced by the signals carried through circuit boards, the connector and contacts. For example, as a signal contact of a differential pair is displaced further from its complimentary signal contact, the signal contacts of one differential pair may become coupled to signal contacts of a different differential pair. As signal contacts of separate differential pairs become coupled to one another, the signal contacts begin to exhibit cross-talk with each other. That is, loosening the coupling between complimentary signal contacts may tighten the coupling between non-complimentary signal contacts. Tightening the coupling between non-complimentary signal contacts increases cross-talk between the contacts. Consequently, interference, noise, and jitter within the multi-layer circuit board, connector and system increases. Therefore, increasing the distance between signal contacts to increase the impedance within a particular differential pair causes a higher degree of interference, noise and jitter. Conversely, decreasing the distance between signal contacts of a differential pair to decrease the amount of interference, noise and jitter may produce a non-uniform or otherwise non-suitable impedance.

A need remains for an improved electrical connector capable of controlling impedance within desired levels.

BRIEF SUMMARY OF THE INVENTION

In accordance with an embodiment of the present invention, a connector assembly has been developed that includes a connector housing having a contact retaining chamber at one end of the connector housing, at least two signal contacts arranged as a differential pair and held in the contact retaining chamber of the connector housing. The signal contacts are separated by a gap. The assembly also includes an impedance tuner block formed of a dielectric material insertable into the contact retaining chamber. The impedance tuner block has at least two channels notched therein. The impedance tuner block includes isolation layers separating the channels. Each channel receives a corresponding one of the signal contacts and each isolation layer is inserted between adjacent signal contacts when the impedance tuner block is inserted into the contact retaining chamber.

The impedance tuner block may also include a plurality of isolation ribs as the isolation layers. One isolation rib is positioned between two adjacent contacts. Optionally, the connector assembly may further include ground contacts separating the differential pairs from one another. The differential pairs may be separates from the ground contacts by the isolation ribs.

The connector assembly further includes at least one impedance adjusting insert securable to the impedance tuner block in a position that is oriented parallel to at least central elongate arms of the signal contacts. The impedance adjusting inserts may be formed of a non-ferrous metal.

Further, embodiments of the present invention include a shell covering the housing and the impedance tuner. The shell opens to allow removal of the impedance tuner. Upon removal of one impedance tuner, a different impedance tuner, having different impedance controlling characteristics may be positioned within the cavity of the electrical connector.

Figure 1:
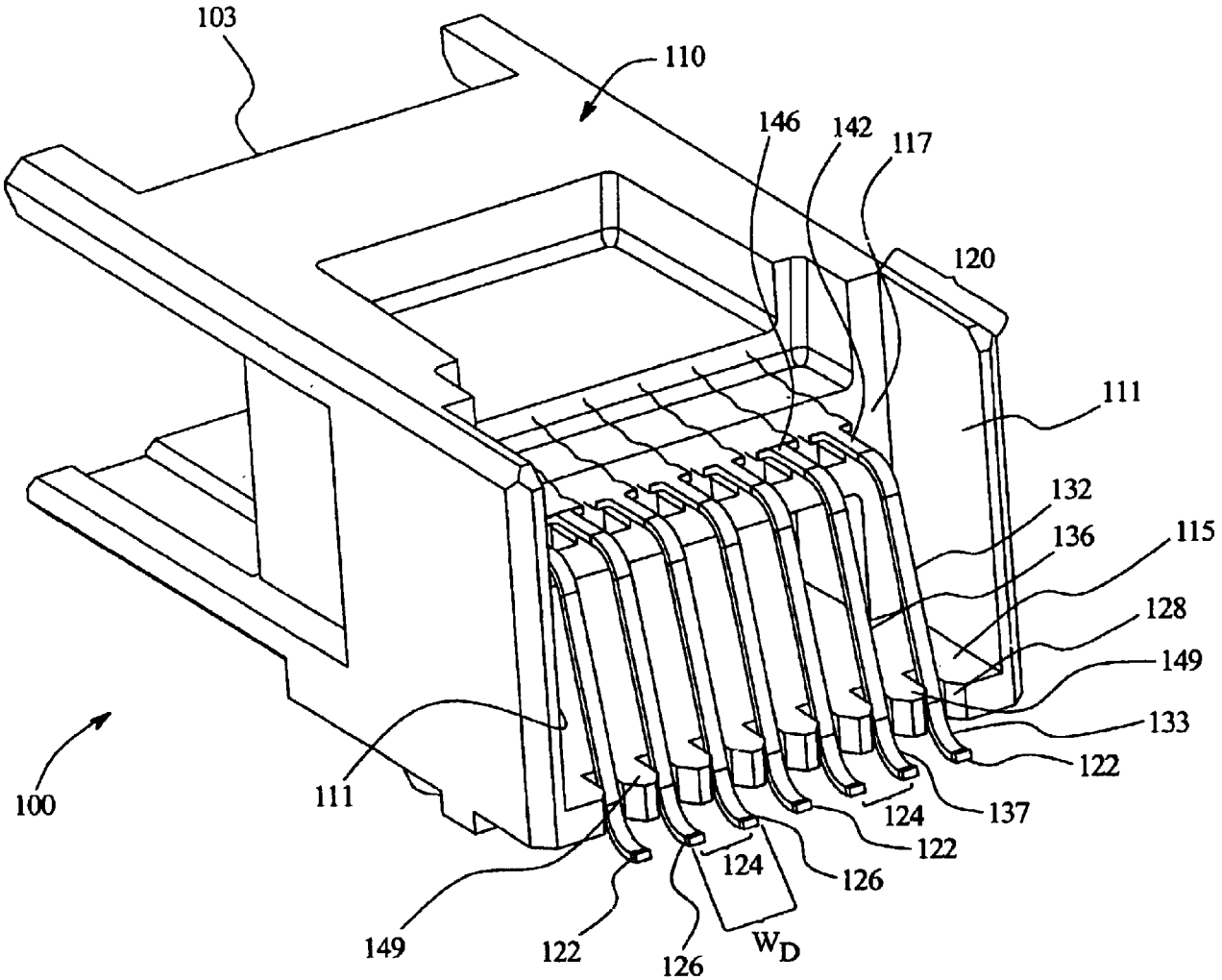
FIG. 1 is an isometric view of a receptacle connector formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 is an isometric view of a receptacle connector 100 formed in accordance with an embodiment of the present invention. The receptacle connector 100 includes a housing 110 having a main body 110, and sidewalls 111, a back wall 117 and a base 115 that define a cavity 120 at an open face of the housing 110. Contact passages 128 are formed in the open end of the base 115. Ground contacts 122 extend from the back wall 117. Each ground contact 122 has a ground contact tail 133 at a terminal end. Similarly signal contacts 126 extend from the back wall 117, and each signal contact 126 has a signal contact tail 137 at a terminal end. The signal and ground contacts 126 and 122 carry differential pair data signals at high speeds, such as 2 Gbits per second, 5 Gbits per second, 10 Gbits per second and the like.

Signal and ground contacts 126 and 122 are interspersed with two (2) signal contacts 126 being adjacent one another, thereby forming a differential pair 124. Adjacent differential pairs 124 are separated from one another by a ground contact 122. As shown in FIG. 1, each signal and ground contact 126 and 122 includes an elongated central arm 136 and 132, respectively, with an arc shaped contact tail 137 and 133, respectively, on a lower end thereof. Each signal contact 126 and ground contact 122 also includes signal and ground lead contact sections 146 and 142, respectively, at the upper end opposite that of the arc shaped contact tails 137 and 133. Each signal and ground contact tail 137 and 133 curves below and outward from a contact passage 128. The contact passages 128 are separated by a series of sections 149 having beveled outer tips. The signal contacts 126 in each differential pair 124 are spaced apart by a width $W_D$ that includes the width of each signal contact 126 plus the space between the signal contacts 126.

The connector 100 also includes a shell (not shown) that covers the housing 110 and cavity 120. The end 103 of the receptacle connector 100 opposite the cavity 120 is received by a plug connector (not shown) having signal and ground contacts (not shown) that connect to the signal contacts 126 and ground contacts 122, respectively, through intermediate signal and ground portions (not shown), respectively. The plug connector, in turn, connects to an electrical cable (not shown) that allows signals to pass from the plug connector to the cable and ultimately to an electrical component (not shown), and vice versa.

Figure 2:
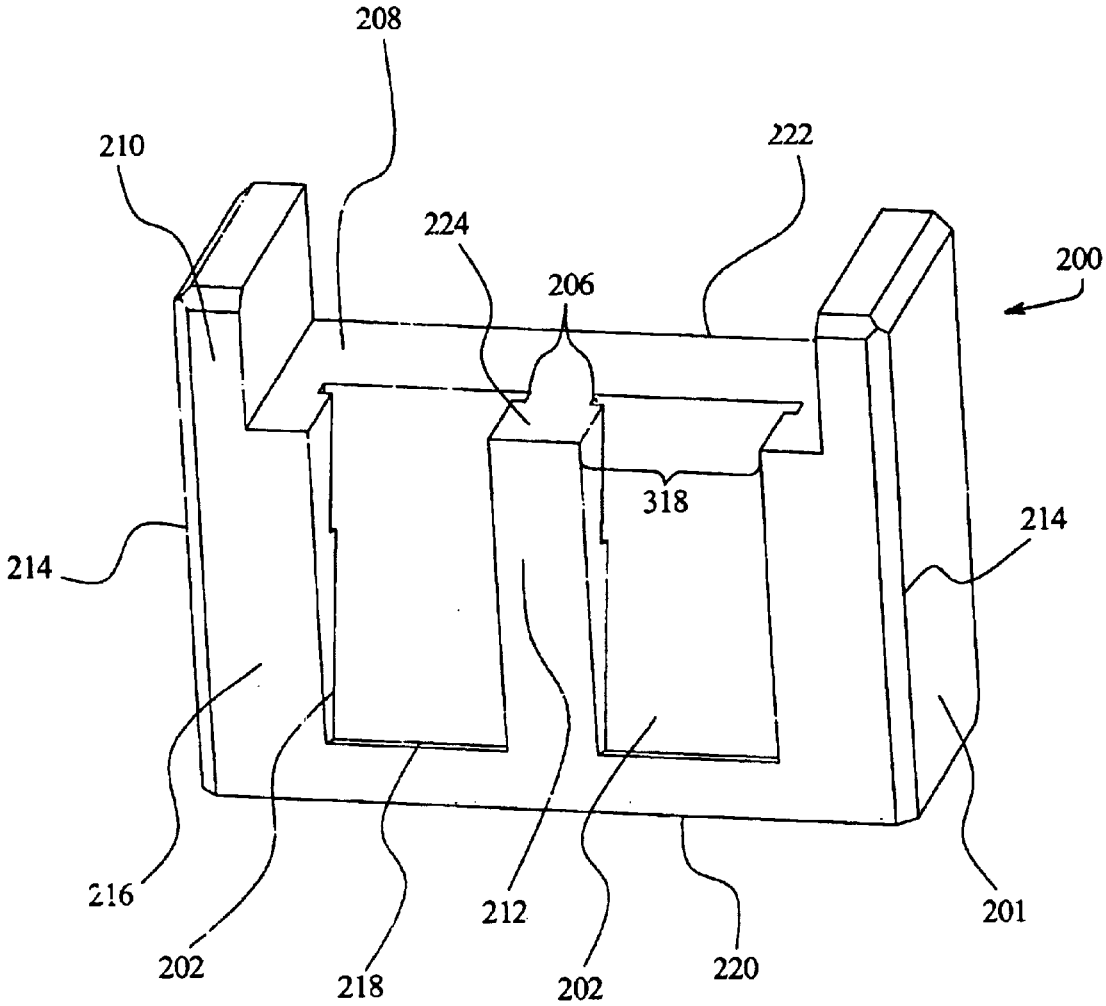
FIG. 2 is an isometric view of an impedance tuner formed in accordance with an embodiment of the present invention.
Figure 3:
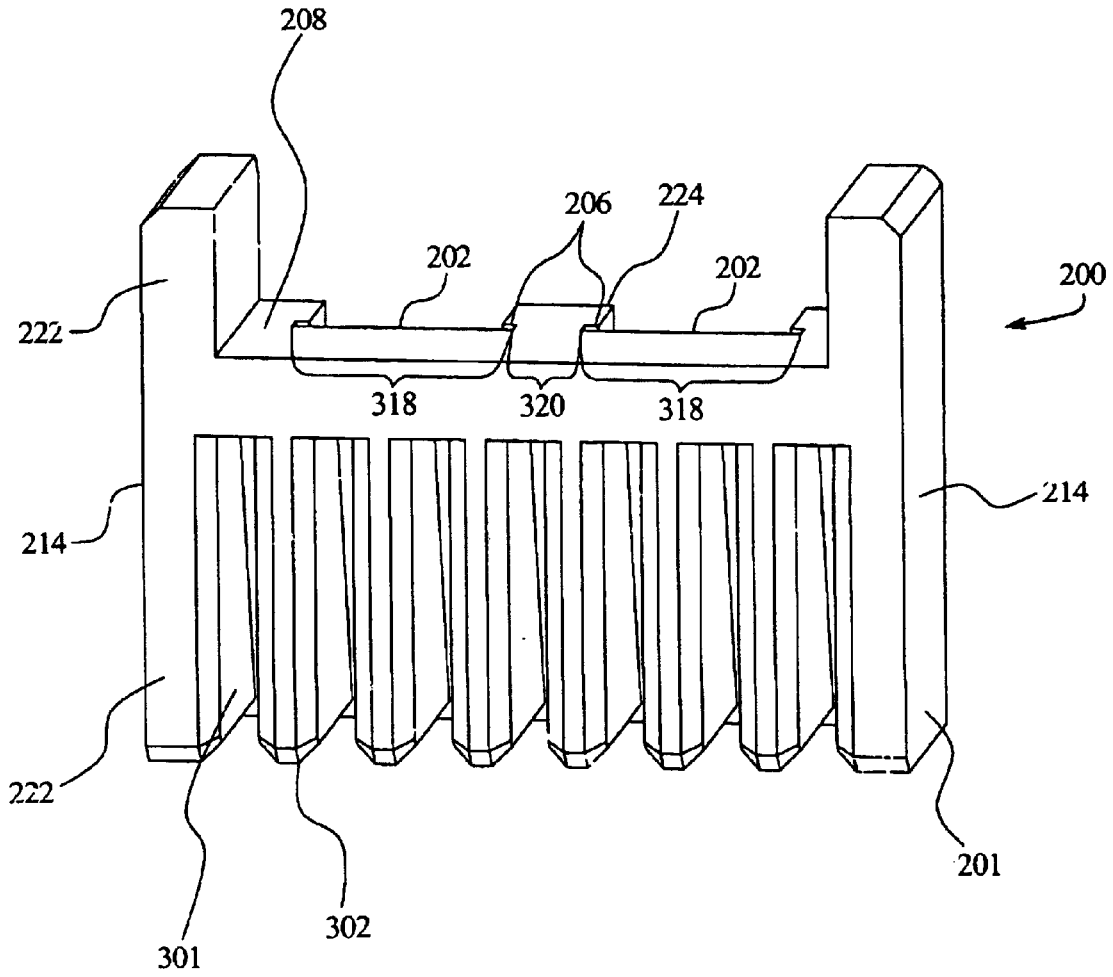
FIG. 3 is an isometric view of an impedance tuner formed in accordance with an embodiment of the present invention.

FIGS. 2 and 3 are isometric views of an impedance tuner 200 formed in accordance with an embodiment of the present invention. The impedance tuner 200 includes a rectangular molded housing 201 having top, bottom, side, front and back walls 208, 220, 214, 216 and 222 and an insert dividing wall 224. The impedance tuner 200 also includes plank shaped insert receptacles 202 formed and angled within the front wall 216. The insert receptacles 202 include retaining bases 218 at lower ends of the receptacles 202 and insertion slots 318 having notches 206 formed in the top wall 208 and extending downward therefrom. The insert receptacles 202 receive and retain impedance adjusting inserts (discussed below with respect to FIG. 4). Thus, the insert receptacles 202 conform to the shape of the impedance adjusting inserts (reference numeral 402 in FIG. 4). As shown in FIGS. 2 and 3, the notches 206 extend less than half the distance from the top wall 208 to the retaining bases 218. The insert receptacles 202 are separated by the insert dividing wall 224 having a reduced portion 320 between the two notches 206.

As shown in FIG. 3, The impedance tuner 200 also includes dielectric isolation walls, or ribs 302 formed within the back wall 222. Upon insertion of the impedance tuner 200 into the connector 100, the ribs 302 separate signal and ground contacts 126 and 122 from one another. The ribs 302 define contact channels 301 that extend into the housing 201 from the back wall 222. Each contact channel 301 is formed to receive a signal or ground contact 126 or 122. The impedance tuner 200 is made of a dielectric material, such as a liquid crystal polymer material, or zenite, that has a dielectric constant greater than air. For example, zenite has a dielectric constant of 3.40 while air has a dielectric constant of 1.00.

Figure 4:
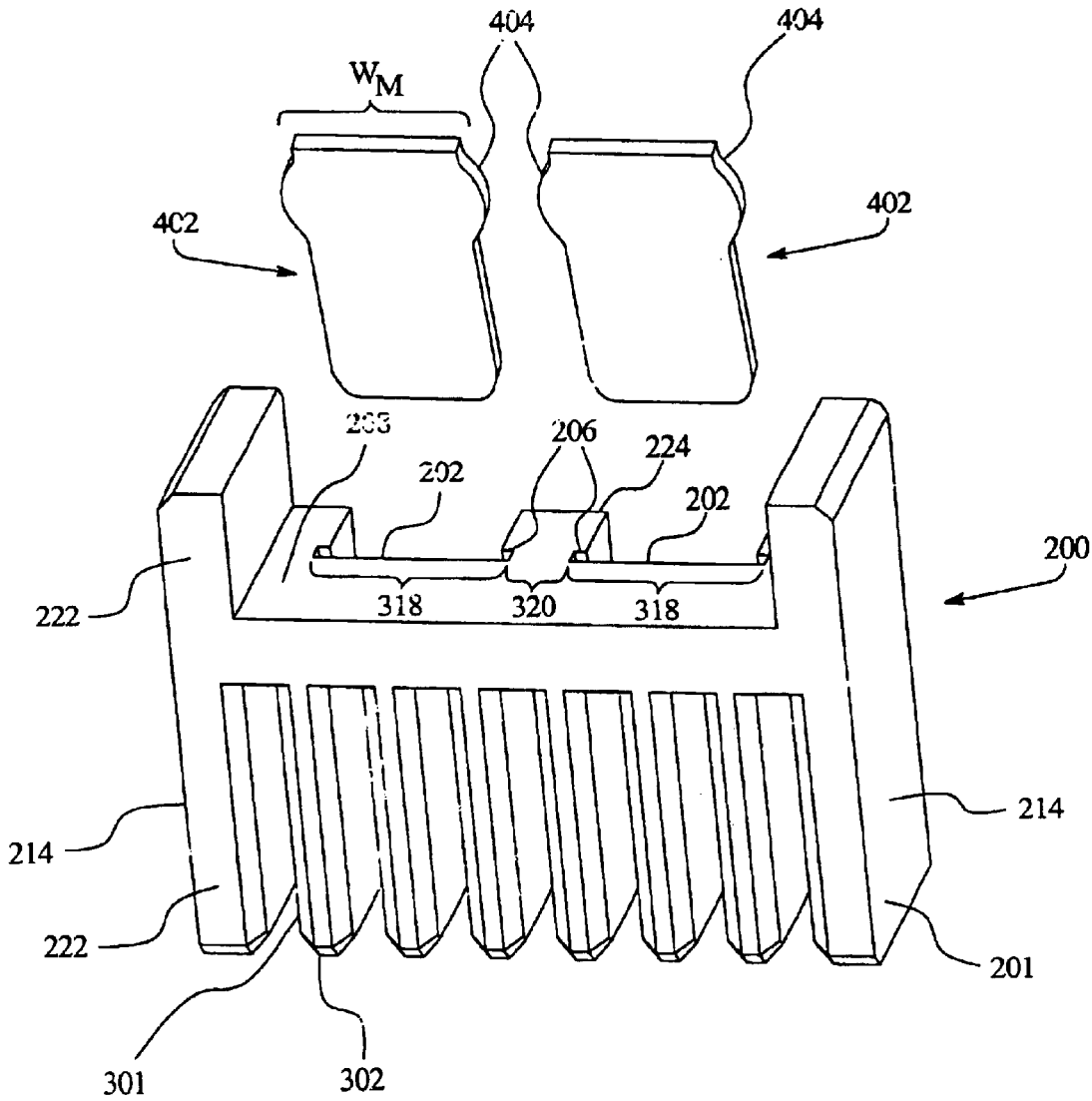
FIG. 4 is an isometric view of an impedance tuner with metallic inserts formed in accordance with an embodiment of the present invention.

FIG. 4 is an isometric view of an impedance tuner 200 with impedance adjusting inserts 402 formed in accordance with an embodiment of the present invention. The impedance adjusting inserts 402 may be a non-ferrous metal, such as brass and the like. The impedance adjusting inserts 402 have tabs 404 located on their sides, extending laterally therefrom. The impedance adjusting inserts 402, each having a width $W_M$, are positioned within the insert receptacles 202 such that the tabs 404 are received and frictionally retained by the notches 204. The retaining bases 218 support the impedance adjusting inserts 402. When the impedance tuner 200 is positioned with the connector 100, the impedance adjusting inserts 402 are positioned over differential pairs 124, as further discussed below.

Figure 5:
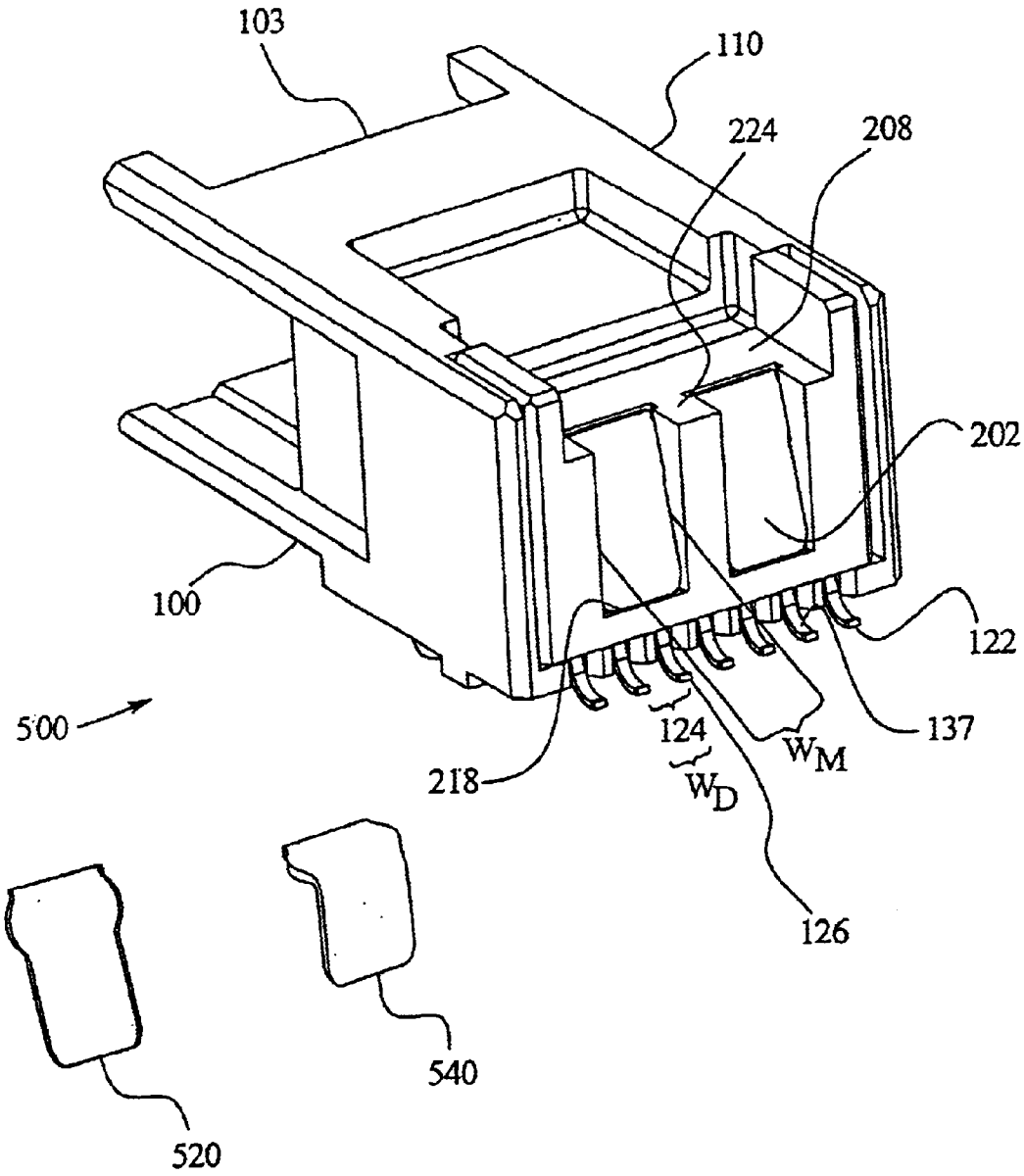
FIG. 5 is an isometric view of an impedance controlled connector assembly 500 formed in accordance with an embodiment of the present invention.

FIG. 5 is an isometric view of an impedance controlled connector assembly 500 formed in accordance with an embodiment of the present invention. The assembly 500 includes the receptacle connector 100 and the impedance tuner 200. The impedance tuner 200 is positioned within the cavity 120 such that each signal contact 126 and ground contact 122 is positioned within a contact channel 301 (shown in FIG. 3). Each signal contact 126 of a differential pair 124 is separated from its counterpart signal contact 126 by a dielectric isolation wall 302 (shown in FIG. 3). Each signal elongated central arm 136 is separated from a ground elongated central arm 132 by a dielectric isolation wall, or rib 302 (view hidden by insertion of impedance tuner 200 into receptacle connector 100). Each signal contact tail 137 and ground contact tail 133 protrudes from the base 115 of the receptacle 100 through a contact passage 128 and is exposed in order to contact traces (not shown) on a circuit board (not shown).

The impedance tuner 200 is held into position by the metallic shell (not shown) that encompasses the connector 100 and the impedance tuner 200. Preferably, the shell is positioned and clamped around the housing 110. The shell may open and close in order to allow one tuner 200 to be removed, and another impedance tuner 200 to be inserted into the cavity 120. Thus, the assembly 500 may accommodate a variety of impedance tuners 200, depending on the desired amount of impedance control. For example, an impedance tuner 200 having a first dielectric constant may be used in some applications. During a different application, the impedance tuner 200 may be removed and replaced with a second impedance tuner 200 having a different dielectric constant, or different impedance adjusting inserts 402 formed of a different metal. In other words, the impedance tuner 200 is interchangeable.

The insert receptacles 202 are formed within the impedance tuner 200 such that each impedance adjusting insert 402 may be positioned in a parallel plane over a corresponding differential pair 124. The width of each impedance adjusting insert 402 is equal, or approximately equal, to the width of a differential pair 124 ($W_M$=$W_D$). In any event, each impedance adjusting insert 402 completely overlaps the width of a differential pair 124. That is, each impedance adjusting insert 402 completely overlaps a portion of a differential pair 124 (e.g., elongated central arms 136 of two signal contacts 126 of a differential pair), but does not touch the signal contacts 126 of the differential pair 124. Rather, the impedance adjusting inserts 402 are separated from the signal contacts 126 by the molded housing 201 and/or air. That is, the impedance adjusting inserts 402 are separated from the signal contacts 126 by dielectric material.

The impedance adjusting inserts 402 are very closely spaced to the signal contacts 126 and ground contacts 122, but the impedance adjusting inserts 402 do not touch the contacts 126 and 122. The impedance adjusting inserts 402 are oriented in a plane that is parallel to the elongated central arms 136 and 132 of the signal contacts 126 and ground contacts 122 in order that the impedance adjusting inserts 402 will conform to a portion of the contacts 126 and 122. The impedance adjusting inserts 402 may be flat metal sheets 520 that run parallel with and overlap the elongated central arms 136 and 132 of the signal and ground contacts 136 and 132, respectively. Alternatively, each insert 402 may be a curved metal sheet 540 that conforms to a greater portion of the contacts 126 and 122 than the flat metal sheet 520. For example, the curved metal sheet 540 may conform to the elongate central arms 136 and 132 and the signal and ground lead contact sections 146 and 142.

The impedance adjusting inserts 402 are spaced apart from one another so that there is little or no coupling between them. For example, the width of the insert dividing wall 224 may be the width of a ground tail 133, so long as each impedance adjusting insert 204 overlaps signal contacts 136 of a differential air 124.

Impedance within the assembly 500 is tuned through the dielectric material of the impedance tuner 200 and the impedance adjusting inserts 402. Impedance is represented by the following equation:

$$Z = \sqrt{\frac{L}{C}}$$

where Z is impedance, L is inductance and C is capacitance. Therefore, increasing the capacitance decreases the impedance. Decreasing capacitance increases the impedance. Capacitance, is further defined by the following equations:

$$C = \frac{Q}{V} \quad C = \frac{eA}{d} \quad e = e_o e_r$$

where Q is the charge on a plate, V is voltage, A is the area of the plates, $e_o$ is the permittivity of free space and $e_r$ is the dielectric constant of the material between the plates.

The capacitance of a system including two plates, such as two signal contacts 126 of a differential pair 124, or a signal tail 126 and a metal plate 402, may be increased by the following:

1) Increasing the dielectric constant ($e_r$) of the material between the plates;
2) Increasing the areas (A) of the plate; or
3) Decreasing the separation between the plates (d).

In order to increase the capacitance, the dielectric material between the plates may be changed. For example, instead of the signal contacts 126 of a differential pair 124 being separated by air, the dielectric isolation walls, or ribs 302 may be placed between the signal contacts 126, such as in the embodiments discussed above. Alternatively, however, ribs 302 may not be placed between the signal contacts 126 of a differential pair 124. Rather, the ribs 302 may be placed only between the differential pairs 124 and the ground contacts 122. Also, alternatively, ribs 302 may not be used. Instead, the impedance tuner 200 may have a molded housing 201 without any ribs 302. Also, alternatively, the metal inserts 402 may not be used. Instead, the dielectric housing 201 may provide the desired amount of impedance control within the assembly 500. However, to increase capacitance even further, a neutral piece(s), such as an impedance adjusting insert 402, may be added to the dielectric material, such as the molded housing 201. Also, alternatively, instead of dielectric ribs 302, the impedance tuner 200 may include metal isolation walls, or ribs protruding from the housing 201 and positioned between all or some of the contacts 126 and 122.

Thus, different impedance tuners 200 may be used within the receptacle connector 100. Variables that affect the impedance within the system include the following: using impedance tuners 200 of different dielectric materials, varying the depths of contact channels 301, utilizing impedance adjusting inserts 402, varying the impedance adjusting inserts 402 among different metals having different dielectric constants, varying the distance between the impedance adjusting inserts 402 and the differential pairs 124, and/or varying the length of the impedance adjusting inserts 402 that conforms to the signal contacts 126 and ground contacts 122. Various impedance tuners 200 having different combinations of these variables may be used with the assembly 500, depending on the desired amount of impedance control within the assembly 500. Thus, impedance tuning and control through interchangeable impedance tuners 200 is provided.

Figure 6:
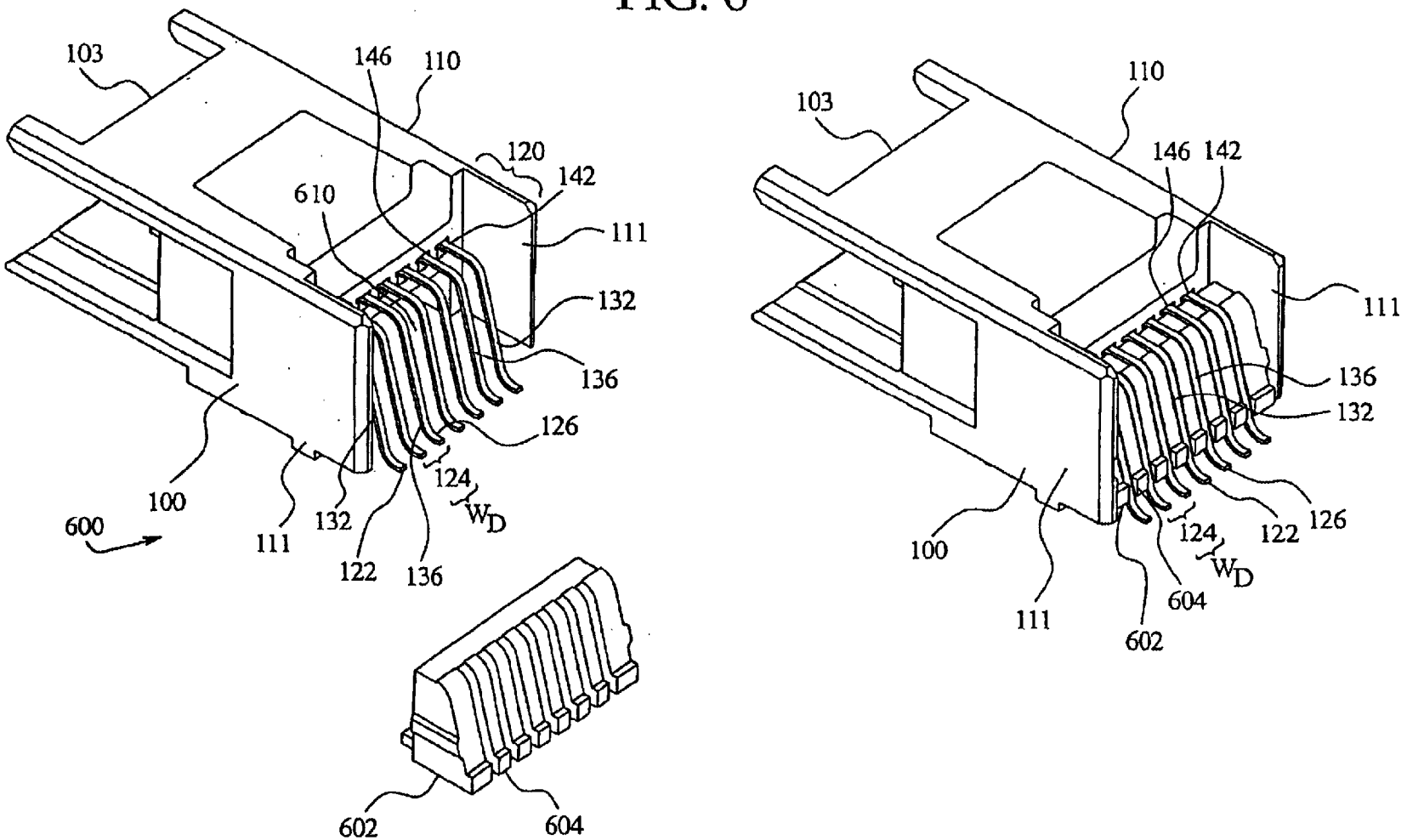
FIG. 6 is an isometric view of an impedance controlled connector assembly 500 formed in accordance with an embodiment of the present invention.

FIG. 6 is an isometric view of an impedance controlled connector assembly 600 formed in accordance with an embodiment of the present invention. The assembly 600 includes dielectric insert 602 having contact channels 604. The assembly 600 differs from the assembly 500 in that the dielectric insert 602 is inserted from underneath the contacts 122 and 126 through an opening 601 in the connector base, as opposed to being positioned over the contacts 122 and 126. The contacts 122 and 126 rest on the contact channels 604, which conform to the contours of the contacts 122 and 126. As shown with respect to FIG. 6, the dielectric insert 602 does not include metallic inserts.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A connector assembly, including:

a connector housing;

at least two signal contacts arranged as a differential pair and at least one ground contact held in said connector housing, said at least two signal contacts being separated by a gap;

an impedance tuner block insertable into said connector housing, said impedance tuner block including a first wall having at least two channels notched therein, said impedance tuner block including isolation layers formed of a dielectric material and separating said channels, each channel receiving a corresponding one of said signal contacts and each isolation layer being inserted between adjacent signal contacts when said impedance tuner block is inserted into said connector housing, said impedance tuner block further including a second wall opposite said first wall, said second wall having at least one insert receptacle; and an impedance adjusting insert in said insert receptacle.

2. The connector assembly of claim 1 wherein said impedance tuner block includes a plurality of isolation ribs as said isolation layers, wherein one of said plurality of isolation ribs is positioned between two adjacent signal contacts.

3. The connector assembly of claim 1 further including a plurality of differential pairs of signal contacts, and a ground contact separating each of said differential pairs, wherein said impedance tuner block includes a plurality of isolation ribs as said isolation layers, said differential pairs being separated from said ground contacts by said isolation ribs.

4. The connector assembly of claim 1 wherein said signal contacts in said differential pair are arranged in a first plane and wherein said impedance tuner block retains said at least one impedance adjusting insert oriented parallel to said first plane.

5. The connector assembly of claim 1 further including an impedance adjusting insert securable to said impedance tuner block adjacent to said at least two channels to overlap corresponding signal contacts received in said at least two channels.

6. The connector assembly of claim 1 wherein said impedance adjusting insert is held adjacent said differential pair.

7. The connector assembly of claim 1, further including multiple sets of differential pairs of signal contacts, said differential pairs aligned in a common plane.

8. An apparatus for controlling impedance within an electrical connector assembly including a housing and a plurality of signal contacts and a ground contact substantially coplanar with said signal contacts, said signal contacts being arranged in a differential pair, said apparatus comprising:

an impedance tuner formed of a dielectric material different than air and adapted to be interchangeably secured in said housing, said impedance tuner including dielectric isolation ribs along a side of said impedance tuner mating with the signal contacts, said impedance tuner being positioned proximate the signal and ground contacts, wherein signal contacts of the differential pair are separated from the ground contact by one of said isolation ribs.

9. The apparatus of claim 8 wherein one of said plurality of isolation ribs is adapted to be positioned between every signal contact.

10. The apparatus of claim 8 wherein said impedance tuner further includes:

at least one impedance adjusting insert removably secured to said impedance tuner, said at least one impedance adjusting insert being oriented parallel to a plane in which said signal contacts are arranged.

11. The connector assembly of claim 8 further including an impedance adjusting insert securable to said impedance tuner block adjacent said signal contacts of said differential pair received in said isolation ribs.

12. The apparatus of claim 8 further including a plurality of impedance adjusting inserts, said inserts aligned in a common plane.

13. A system for controlling impedance within an electrical connector assembly, comprising:

an electrical connector including:

a housing; and a plurality of signal contacts and ground contacts aligned in a common plane, said signal and ground contacts held in, and exposed from, said housing, said signal contacts being arranged in differential pairs;

an interchangeable impedance tuner formed of a dielectric material different than air, said interchangeable impedance tuner, comprising:

an impedance adjusting insert; and an insert receptacle for receiving said at least one insert, said impedance tuner being positioned proximate said plurality of signal contacts and ground contacts, wherein said impedance adjusting metal insert is oriented parallel to said signal contacts, and wherein said impedance adjusting insert overlaps at least two signal contacts.

14. The system of claim 13 wherein said interchangeable impedance tuner includes a plurality of dielectric isolation ribs, wherein one of said plurality of dielectric isolation ribs is positioned between two adjacent signal and ground contacts.

15. The system of claim 13 wherein said interchangeable impedance tuner includes a plurality of dielectric isolation ribs, wherein one differential pair of signal contacts is separated from a ground contact by at least one of said dielectric ribs.

16. The system of claim 13 wherein said at least one impedance adjusting insert is a non-ferrous metal.

17. A system for controlling impedance within an electrical connector assembly, comprising:

an electrical connector including:

a housing; and a plurality of signal contacts and ground contacts held in, and exposed from, said housing, said signal contacts being arranged in differential pairs;

an interchangeable impedance tuner formed of a dielectric material different than air, said interchangeable impedance tuner including:

a plurality of dielectric isolation ribs on one side surface thereof;

an impedance adjusting insert; and an insert receptacle for receiving said at least one insert, said impedance tuner being positioned within said housing proximate said plurality of said signal contacts and ground contacts, wherein one of said plurality of dielectric isolation ribs is positioned between two adjacent signal and ground contacts, wherein said impedance adjusting insert is oriented parallel to said signal contacts, and wherein said impedance adjusting insert overlaps at least two signal contacts.

18. The system of claim 17 wherein said one of said plurality of dielectric ribs is positioned between two adjacent signal and ground contacts.

19. The system of claim 17 wherein said at least one insert is a non-ferrous metal.

* * * * *